US007866390B2

(12) United States Patent
Latiolais, Jr. et al.

(10) Patent No.: US 7,866,390 B2
(45) Date of Patent: Jan. 11, 2011

(54) CASING MAKE-UP AND RUNNING TOOL ADAPTED FOR FLUID AND CEMENT CONTROL

(75) Inventors: Burney J. Latiolais, Jr., Lafayette, LA (US); Keith Thomas Lutgring, Lafayette, LA (US); Samuel P. Hawkins, III, Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 72 days.

(21) Appl. No.: 11/555,391

(22) Filed: Nov. 1, 2006

(65) Prior Publication Data

US 2008/0099196 A1 May 1, 2008

Related U.S. Application Data

(63) Continuation-in-part of application No. 11/512,601, filed on Aug. 29, 2006, now Pat. No. 7,370,698, which is a continuation of application No. 10/047,727, filed on Jan. 15, 2002, now Pat. No. 7,096,948, which is a continuation of application No. 09/837,447, filed on Apr. 17, 2001, now abandoned, which is a continuation of application No. 09/206,876, filed on Dec. 8, 1998, now Pat. No. 6,279,654, which is a continuation-in-part of application No. 08/850,496, filed on May 2, 1997, now Pat. No. 5,918,673, which is a continuation-in-part of application No. 08/726,112, filed on Oct. 4, 1996, now Pat. No. 5,735,348.

(51) Int. Cl.
*E21B 37/04* (2006.01)

(52) U.S. Cl. ..... 166/285; 166/70; 166/177.4

(58) Field of Classification Search ..... 166/285, 166/70, 72, 177.4
See application file for complete search history.

(56) References Cited

U.S. PATENT DOCUMENTS

| | | | |
|---|---|---|---|
| 0,776,523 | A | 12/1904 | Lukins |
| 1,445,680 | A | 2/1923 | Guess |
| 1,580,352 | A | 4/1926 | Ventresca |

(Continued)

FOREIGN PATENT DOCUMENTS

| | | | |
|---|---|---|---|
| EP | 1475512 | A1 | 10/2004 |

(Continued)

OTHER PUBLICATIONS

Jan. 3, 2005, BJ Tubular Services "CRT 14 Brochure".

(Continued)

*Primary Examiner*—William P Neuder
(74) *Attorney, Agent, or Firm*—Patrick K. Steele; Streets & Steele

(57) ABSTRACT

The apparatus of the present invention provides a top drive supported tool for making up and running casing strings into a borehole. The tool comprises a fill-up and circulation assembly and a launcher assembly that is adapted to cooperate with a connectable cement wiper plug assembly for launching wiper plugs that control cement placement in the annulus between a casing string and a borehole containing the casing string. The tool of the present invention shortens or eliminates delays in well operations, thereby improving integrity of cement liners formed by placing cement slurry in a targeted interval.

32 Claims, 5 Drawing Sheets

U.S. PATENT DOCUMENTS

| | | | | |
|---|---|---|---|---|
| 1,619,254 | A | | 3/1927 | Hart |
| 1,621,947 | A | | 3/1927 | Moore |
| 1,779,123 | A | | 10/1930 | Gates |
| 2,108,499 | A | | 2/1938 | Moseley |
| 2,191,000 | A | | 2/1940 | Thomas |
| 2,953,406 | A | | 9/1960 | Young |
| 3,265,431 | A | | 8/1966 | Burner |
| 3,301,334 | A | | 1/1967 | Odgers et al. |
| 3,677,341 | A | | 7/1972 | Burns et al. |
| 3,758,146 | A | | 9/1973 | Kaercher et al. |
| 4,074,774 | A | | 2/1978 | Brown et al. |
| 4,093,294 | A | | 6/1978 | Taylor |
| 4,100,968 | A | | 7/1978 | Delano |
| 4,190,119 | A | | 2/1980 | Loftis et al. |
| 4,235,469 | A | | 11/1980 | Denny et al. |
| 4,244,616 | A | | 1/1981 | Buchalet |
| 4,320,915 | A | | 3/1982 | Abbott et al. |
| 4,658,915 | A | | 4/1987 | Goris et al. |
| 4,865,135 | A | | 9/1989 | Moses |
| 4,919,881 | A | | 4/1990 | Hankinson et al. |
| 4,997,042 | A | | 3/1991 | Jordan et al. |
| 5,036,927 | A | | 8/1991 | Willis |
| 5,095,988 | A | * | 3/1992 | Bode ..... 166/291 |
| 5,253,710 | A | | 10/1993 | Carter et al. |
| 5,294,228 | A | | 3/1994 | Willis et al. |
| 5,297,833 | A | | 3/1994 | Willis et al. |
| 5,551,521 | A | | 9/1996 | Vail, III |
| 5,584,343 | A | | 12/1996 | Coone |
| 5,641,021 | A | | 6/1997 | Murray et al. |
| 5,735,348 | A | | 4/1998 | Hawkins, III |
| 5,887,660 | A | | 3/1999 | Yokley et al. |
| 5,890,537 | A | | 4/1999 | Lavaure et al. |
| 5,918,673 | A | | 7/1999 | Hawkins et al. |
| 5,960,881 | A | * | 10/1999 | Allamon et al. ..... 166/291 |
| 5,971,079 | A | | 10/1999 | Mullins |
| 6,010,171 | A | | 1/2000 | Margiottiello |
| 6,142,545 | A | | 11/2000 | Penman et al. |
| 6,161,617 | A | | 12/2000 | Gjedebo |
| 6,279,654 | B1 | | 8/2001 | Mosing et al. |
| 6,302,199 | B1 | | 10/2001 | Hawkins et al. |
| 6,309,002 | B1 | | 10/2001 | Bouligny |
| 6,311,792 | B1 | | 11/2001 | Scott et al. |
| 6,431,626 | B1 | | 8/2002 | Bouligny |
| 6,443,241 | B1 | | 9/2002 | Juhasz et al. |
| 6,527,047 | B1 | | 3/2003 | Pietras |
| 6,571,880 | B1 | | 6/2003 | Butterfield, Jr. et al. |
| 6,595,288 | B2 | | 7/2003 | Mosing et al. |
| 6,622,796 | B1 | | 9/2003 | Pietras |
| 6,637,526 | B2 | | 10/2003 | Juhasz et al. |
| 6,679,333 | B2 | | 1/2004 | York et al. |
| 6,688,398 | B2 | | 2/2004 | Pietras |
| 6,691,801 | B2 | | 2/2004 | Juhasz et al. |
| 6,725,938 | B1 | | 4/2004 | Pietras |
| 6,732,822 | B2 | | 5/2004 | Slack et al. |
| 6,742,584 | B1 | | 6/2004 | Appleton |
| 6,938,709 | B2 | | 9/2005 | Juhasz et al. |
| 7,004,259 | B2 | | 2/2006 | Pietras |
| 7,007,753 | B2 | | 3/2006 | Robichaux et al. |
| 7,021,374 | B2 | | 4/2006 | Pietras |
| 7,037,356 | B2 | | 5/2006 | Ibaraki et al. |
| 7,096,977 | B2 | | 8/2006 | Juhasz et al. |
| 7,128,161 | B2 | | 10/2006 | Pietras |
| 7,137,454 | B2 | | 11/2006 | Pietras |
| 7,213,656 | B2 | | 5/2007 | Pietras |
| 7,219,744 | B2 | | 5/2007 | Pietras |
| 7,287,584 | B2 | | 10/2007 | Angman et al. |
| 7,325,610 | B2 | | 2/2008 | Giroux et al. |
| 7,353,880 | B2 | | 4/2008 | Pietras |
| 7,513,300 | B2 | | 4/2009 | Pietras |
| 2002/0029879 | A1 | | 3/2002 | Mosing et al. |
| 2004/0216924 | A1 | | 11/2004 | Pietras |
| 2005/0051343 | A1 | | 3/2005 | Pietras et al. |
| 2006/0000600 | A1 | | 1/2006 | Pietras |
| 2006/0118293 | A1 | | 6/2006 | Juhasz et al. |
| 2006/0124293 | A1 | | 6/2006 | Juhasz et al. |
| 2006/0124305 | A1 | | 6/2006 | Juhasz et al. |
| 2006/0124353 | A1 | | 6/2006 | Juhasz et al. |
| 2007/0107909 | A1 | | 5/2007 | Pietras |
| 2007/0169930 | A1 | | 7/2007 | Shahin et al. |
| 2008/0053660 | A1 | | 3/2008 | Angman |
| 2008/0185140 | A1 | | 8/2008 | Pietras |
| 2008/0202751 | A1 | * | 8/2008 | Mosing et al. ..... 166/285 |
| 2008/0210063 | A1 | | 9/2008 | Slack |

FOREIGN PATENT DOCUMENTS

| | | | |
|---|---|---|---|
| GB | 9815809.0 | | 2/2000 |
| GB | 2340856 | A | 3/2000 |
| GB | 2340859 | A | 3/2000 |
| GB | 2345074 | A | 6/2000 |
| GB | 2347441 | A | 6/2000 |
| WO | WO9618799 | | 6/1996 |
| WO | WO2000005483 | | 2/2000 |
| WO | WO2004053288 | | 6/2004 |

OTHER PUBLICATIONS

Nov. 1, 2006, National Oil well Varco "CRT Model 350 Brochure".
Sep. 2005, "Drilling Contractor Magazine, Paul Murray, Drilling Crews Can Operate CRT, Resulting in Lower Costs".
Frank's Casing Crew & Rental Tools, Inc. —FC-1 and FC-2 Pill-Up and Circulating Tool—FACTS Fill-Up and Cementing Tool; 7 pages.
U.S. Patent and Trademark Office, "U.S. Appl. No. 12/114,755 Office Action" dated Jan. 16, 2009, 8 pages.
PCT/US2007-080717 International Search Report and Written Opinion, Nov. 3, 2008, 14 pages.
U.S. Appl. No. 12/114,755, "Methods and Devices for Forming a Wellbore with Casing" filed May 3, 2008.
OTC 1988, "MCS remote-operated Internal Lift Tool for piling and conductors", Marine Contractor Services, Inc. Brochure, 9 pages.
U.S. Appl. No. 11/912,665, "Gripping Tool", Maurice Slack, filed Oct. 25, 2007.
PCT "Written Opinion of the International Searching Authority" May 14, 2009, 8 pages.

* cited by examiner

CASING MAKE-UP AND RUNNING TOOL ADAPTED FOR FLUID AND CEMENT CONTROL

This application is a continuation-in-part of U.S. patent application Ser. No. 11/512,601 filed on Aug. 29, 2006 now U.S. Pat. No. 7,370,698 which is a continuation of U.S. patent application Ser. No. 10/047,727, filed on Jan. 15, 2002 now U.S. Pat. No. 7,096,948 which is a continuation of U.S. patent application Ser. No. 09/837,447, filed on Apr. 17, 2001 now abandoned which is a continuation of U.S. patent application Ser. No. 09/206,876, filed on Dec. 8, 1998 now U.S. Pat. No. 6,279,654 which was a continuation-in-part of U.S. patent application Ser. No. 08/850,496, filed May 2, 1997, now U.S. Pat. No. 5,918,673, which was a continuation-in-part of U.S. patent application Ser. No. 08/726,112, filed Oct. 4, 1996, now U.S. Pat. No. 5,735,348.

BACKGROUND OF THE INVENTION

1. Field of the Invention

This invention relates to equipment used in the drilling and completion of subterranean wells, and more specifically to equipment used in circulating fluid and in the annular placement of cement between a pipe string and an earthen borehole.

2. Background of the Related Art

Oil and gas is recoverable from geologic reservoirs by drilling a deep borehole into the earth's crust to a petroleum reservoir. Casing is a protective liner comprising many casing segments threadably coupled at the ends to form an elongated string of pipe. The casing string is made up to the desired length and cemented into the borehole by pumping a predetermined volume of cement slurry down through the bore of the casing string and into the casing—borehole annulus along a targeted interval of the borehole. The cement liner formed around the casing string reinforces the casing string, isolates the casing from corrosive elements and prevents unwanted cross-flow between geologic formations penetrated by the borehole.

Proper conditioning of the borehole prior to placement of the cement slurry improves the quality and effectiveness of the cement liner. Sustained circulation of drilling fluid down the bore of the casing string and back to the surface through the annulus suspends and removes unwanted mud filter cake, drill cuttings and other debris that, if left in the annulus, may compromise the quality of the cement liner and lead to well failure. Drillable cement wiper plugs may be used to isolate a pumped volume of cement slurry from the fluid circulated to condition and clean the borehole and to displace cement in the annulus. The drillable cement wiper plugs may be deployed into the bore of the casing string, one ahead of and one behind the cement slurry, to prevent contamination.

Unwanted delays may result from the need for rigging up cement wiper plug launching assemblies or other tools used for cement placement, and from disconnecting fluid lines and connecting cement lines that feed the cement slurry to the bore of the casing string. Prolonged static conditions prior to cement placement may allow cuttings and debris to settle and accumulate at narrow clearances in the annulus. Too often, the delay between circulating fluid to clean the annulus and placement of cement compromises the quality of the cement liner, and there is a need for minimizing or eliminating the delay in order to improve the quality of the cement liner.

Accordingly, there is a need to for a casing make up, running and circulation tool that allows transition from circulation of drilling fluid into the borehole to placement of cement without prolonged delay. There is a need for a casing make up and running tool that allows deployment of cement wiper plugs into the bore of the casing string to isolate the cement slurry from other fluids without prolonged delays for rigging up tools after landing the casing string into the wellbore and circulating the well. There is a need for a casing make-up and running tool that can rotate and reciprocate the casing string during cement placement to improve the cement liner by assuring that cement fills substantially all voids. There is a need for a casing make-up running tool that can selectively be used for fill up of the casing string or circulation of fluid to condition the borehole during casing running operations and for a tool that can transition from conditioning the borehole to the cement placement phase without removing the tool from the casing string. There is a need for a casing make-up and running tool that enables an operator to minimize the amount of time required to convert from casing running configuration to a cementation configuration.

SUMMARY OF THE PRESENT INVENTION

The present invention is directed to a method and tool that satisfies the aforementioned and other needs, a casing make-up and running tool adapted for facilitating the intermittent fill up of the casing string and the circulation of fluid in a borehole during and after casing running operations, and for facilitating the lunching of cement wiper plugs and the placement of cement into a targeted interval of the annulus around the string of casing in the borehole.

The present invention is directed to a tool and system for making up and running casing joints to form a casing string, for managing fluid levels in the casing string and fluid displacement into and out of the borehole, and for cementing the casing string into a well. The system comprises a launching assembly for selectively introducing launching members, such as balls or darts, for being received into the cement wiper plug assembly to deploy cement wiper plugs into the bore of a casing string supported by the top drive. The tool comprises an apparatus for coupling to and supporting a cement wiper plug assembly for selectively launching cement wiper plugs into the proximal end of a casing string. These cement wiper plugs are selectively deployable to isolate cement slurry being pumped down the casing string from other fluids to prevent contamination of cement. The tool further comprises a vertically reciprocable top drive mounted casing running tool adapted for supporting and rotating the casing, and for receiving a flow of pressurized fluid and delivering the fluid to the bore of the casing string. The top drive may be vertically reciprocated and supported by a block and draw works coupled to a lift point secured to the body of the top drive. The top drive has a downwardly disposed output drive shaft, or quill, coupled to the motor of the top drive. The top drive rotatably supports a casing gripping assembly for gripping and vertically supporting the casing string and a fill up and circulation assembly for managing fluid and enabling cement placement.

The casing make up and running tool of the present invention comprises a launcher assembly that cooperates with a cement wiper plug assembly for selectively deploying wiper plugs into the bore of the casing string to manage the placement of cement slurry. The launcher assembly may be integral with the top drive assembly, supported by the body of the top drive, or supported by the quill of the top drive. The launcher assembly selectively and sequentially launches launching members, such as spherical balls or elongated darts, into the bore of the casing string. Each launching member launched by the launcher assembly is captured or received within a bore or receiving port of a specific wiper plug of the cement wiper plug assembly in order to deploy the wiper plug into the bore of the casing string. The launcher assembly selectively launches a launching member into the bore of the casing string either at the onset or at the conclusion of introduction of cement slurry into the bore of the casing string. Each cement wiper plug receives a mating launching member to substantially close a fluid passage in the cement wiper plug to isolate the pressure source, such as a pump, from the bore of the casing string. Upon reaching a threshold differential force on the cement wiper plug, the plug deploys to create a movable seal between the drilling fluid and cement slurry to avoid commingling of the two fluids and to displace the cement slurry into the borehole annulus to the desired location.

In addition to the launcher assembly, the casing make up and running tool of the present invention also comprises a fill up and circulation assembly to provide management and control of fluid in the borehole. In the fill up mode, the fill up and circulation assembly is used to intermittently add fluid to the bore of the casing string to manage the fluid level in the casing string and to prevent unwanted differential pressure (from the annulus into the casing string) that could, if unmanaged, collapse the casing string. In the circulation mode, an elastomer packer element of the fill up and circulation assembly engages the proximal end of the casing string to enable pressurization of the bore of the casing string to force introduced fluid down the bore of the casing string, out of the distal end of the casing string and into the annulus between the casing string and the borehole wall. By recovery of fluid displaced from the annulus at the surface, the fluid may be reconditioned and reused.

The casing make up and running tool of the present invention comprises a gripping assembly rotatably supported by the quill of the top drive that engages and grips either the internal wall or the external wall, or both, of the proximal end of the casing string. The gripping assembly may comprise a radial gripping mechanism to engage and support the casing string.

DETAILED DESCRIPTION OF THE PRESENT INVENTION

A string of casing suspended in a borehole may weigh hundreds of thousands of pounds or more, and a robust support structure, such as a derrick, is required to suspend a casing string in the borehole. The casing make-up and running tool of present invention is adapted for being supported above the borehole by a support structure, such as a derrick.

Figure 1:
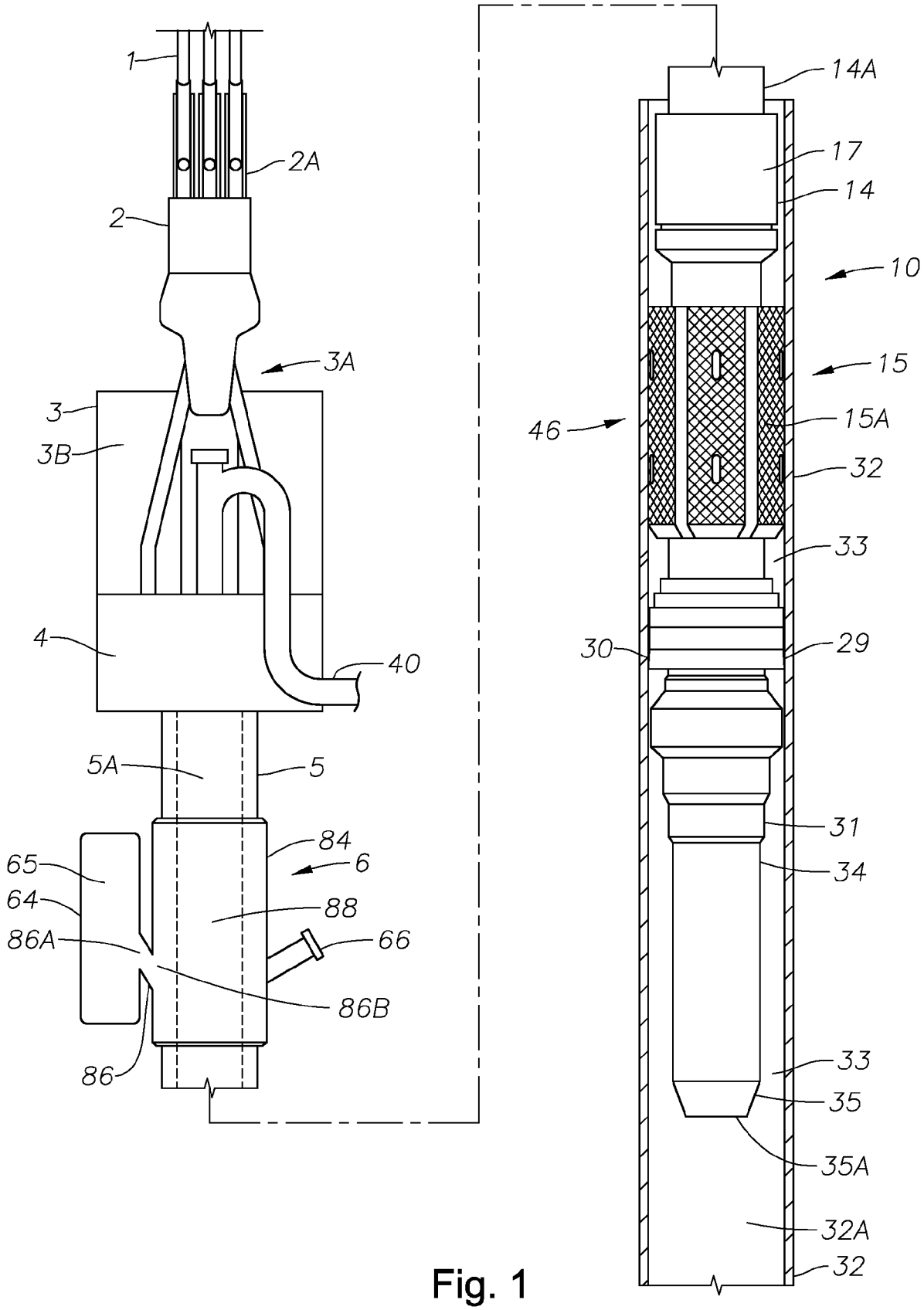
FIG. 1 is an elevation view, with casing pipe shown in cross-section, of an embodiment of the casing make up and running tool of the present invention having a launcher assembly supported by a top drive, and a rotatable internal gripping assembly for gripping and supporting the casing string. The tool shown in FIG. 1 is fitted with a fluid fill-up and circulation assembly.

FIG. 1 is an elevation view of one embodiment of the casing make up and running tool of the present invention comprising a top drive 3 having an upwardly disposed lift eye 3A coupled to and supporting a body 3B and a motor drive assembly 4 secured to the body. The casing make up and running tool is supported by an overhead load-bearing structure (not shown), such as a derrick, that supports a block 2 with a draw works 2A that cooperates with multiple loops of a cable 1. The motor drive assembly 4 of the top drive 3 provides for powered rotation of a generally downwardly disposed drive shaft, or quill 5.

Fluid flow is provided to the top drive 3 from a pump (not shown) coupled to an inlet to the fluid hose 40. The pump discharge (not shown) and the fluid hose 40 form a portion of a fluid conduit for introducing fluid into the bore 32A of the casing string 32. The quill 5 of the top drive 3 has a bore 5A that communicates with fluid hose 40 to form a portion of the fluid conduit, which is described in more detail below. For purpose of illustration, but not by way of limitation, the following discussion and the appended drawings refer to and depict, respectively a launcher assembly having, in this embodiment, two spherical balls of different diameters. It should be understood that two different-sized darts or other launching members may be readily substituted for spherical balls while still maintaining the function of the launcher assembly, which is to selectively launch cement wiper plugs from the cement wiper plug assembly (see element 57 in FIGS. 2-4) to control cement placement.

Figure 2:
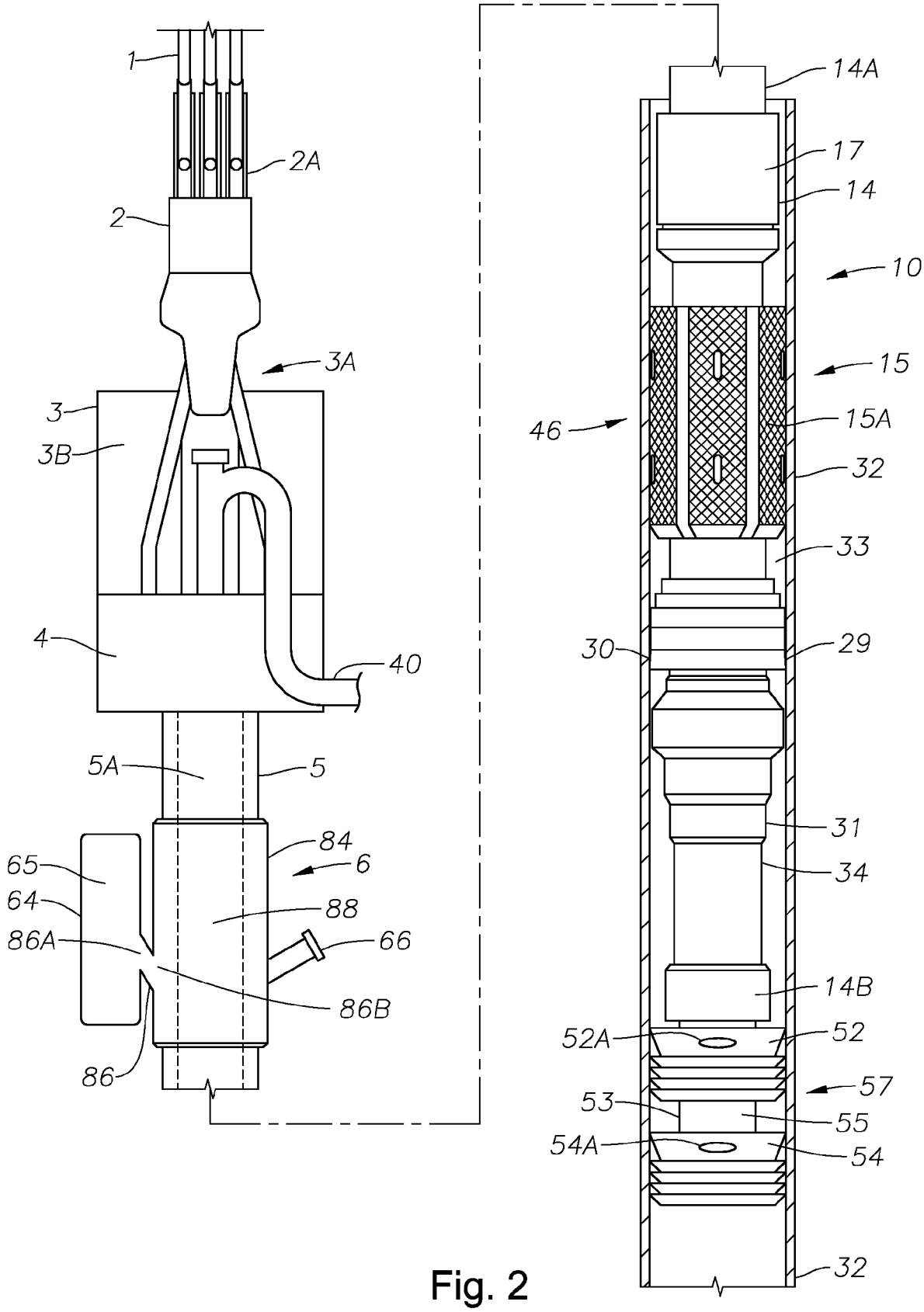
FIG. 2 is an elevation view, with casing pipe shown in cross-section of the embodiment of the casing make-up and running tool of FIG. 1 supporting a cement wiper plug assembly that is coupled to the casing make-up and running tool for cooperating with the launcher assembly for strategic placement of cement slurry in the annulus.

The embodiment of the casing make up and running tool of the present invention shown in FIGS. 1 and 2 comprises a launcher assembly 6 comprising a ball or dart dropping apparatus 64 having a ball chamber 65, a ball passageway 86 coupled to a launcher sub 84 having a central bore 88 there through. The ball chamber 65 feeds into an inlet 86A of the ball passageway 86, and the outlet 86B of the ball passageway 86 feeds into the bore 88 of the launcher sub 84 so that the ball passageway 86 is openable to place the ball chamber 65 in communication with the bore 88 of the launcher sub 84. The bore 88 of the launcher sub 84 is aligned with the bore 5A of the quill 5 of the top drive unit 3. In this embodiment, the fluid conduit comprises the pump discharge (not shown), the fluid hose 40 providing pressurized fluid to the top drive, the bore 5A of the quill 5 and the bore 88 of the launcher sub 84, and the fluid conduit comprising these components feeds downwardly into the borehole, through one or more other bores, into the bore 32A of the casing string 32.

In the embodiment of the present invention shown in FIGS. 1 and 2, the launcher sub 84 of the launcher assembly 6 is either fixed to or rotatably secured to the body 3B of the top drive. In the fixed embodiment, the launcher sub 84 remains stationary when the quill 5 of the top drive unit rotates an extension sleeve that is disposed within the stationary launcher sub 84 of the launcher assembly 6. The launcher sub 84 comprises a sub with a swivel seal on the inner quill extension to permit the launcher sub 84 to remain stationary as the quill 5 and the extension rotates with the top drive 3. In an alternate embodiment, the launcher sub 84 of the launcher assembly 6 is threadably coupled to the quill 5 of the top drive. When the top drive quill 5 rotates, the launcher sub 84 that is threadably coupled to the quill 5 also rotates. Fluid hoses (not shown) used for operation and control of the launcher assembly 6 must be connected to their respective termination sites on the launcher sub 84 after the casing string is fully made up and ready to be lowered into position for cementing in the borehole. In this embodiment, the ball dropping apparatus 64 may be designed to facilitate loading of balls (see elements 42, 44 in FIG. 4) prior to the cementing phase of well completion. It should be understood that darts having different diameters or other launching members may be substituted for the balls shown in FIG. 4 without loss of function of the launcher assembly or the cement wiper plug assembly, which is described below.

In an alternate embodiment, also shown in FIGS. 1 and 2, the launcher sub 84 is rotatably secured to the body 3B of the top drive 3. The launcher sub 84 may be rotatable with and secured to the quill 5 of the top drive.

The fixed and the rotatable embodiments of the launcher sub 84 both are adapted to cooperate with a cement wiper plug assembly (see element 57 in FIGS. 2-4) that is described in detail below. A launching member, such as a ball (see elements 42, 44 in FIG. 5), is launched from the ball chamber 65 through the inlet 86A and then the outlet 86B of the passageway 86 into the bore 88 of the launcher sub 84 to enter the fluid conduit when the cement wiper plug assembly 57 is coupled to the casing make up and running tool to enable controlled placement of cement.

The launcher assembly 6 also comprises a cement port (see element 66 in 32A FIGS. 1, 2 and 4 and element 43 in FIG. 3) for introducing cement slurry into the bore of the quill 5 and, ultimately, into the bore of the casing string 32. Cement may also be introduced into the bore 32A of the casing string 32 through hose 40.

The casing make-up and running tool of the present invention also comprises a casing gripping assembly for gripping and suspending a casing string. As shown in FIGS. 1 and 2, the top drive 3 rotatably supports a gripping assembly 14 that engages and grips the proximal (surface) end 46 of the casing string 32. The gripping assembly 14 shown in FIGS. 1 and 2 comprises an internally gripping elevator 15 having a generally circumferential arrangement of radially outwardly disposable pipe gripping members 15A. The gripping assembly 14 is suspended above the borehole (not shown) and within the bore 32A of the casing string 32 to forcibly engage the internal wall of the casing string 32 to grip and support the casing string 32 in the borehole. An actuator 17 is used to urge pipe gripping members 15A into radial engagement with the internal wall of the casing string 32.

As shown in FIGS. 1 and 2, raising and lowering the top drive 3 using the block 2 and draw works 2A while the casing string 32 is supported by the gripping assembly 14 vertically reciprocates the casing string 32. Furthermore, rotation of the quill 5 of the top drive 3 while the casing string 32 is supported by the gripping assembly 14 rotates the casing string 32. Collars, adapters, subs and housings may be coupled between the quill 5 of the top drive 3 and the gripping assembly 14 for supporting the gripping assembly 14, the launcher assembly 6, the fill up and circulation assembly 29, and others. These collars, adapters, subs and housings, such as the gripping assembly sub 14A, can be used to obtain the optimal spatial relationship between various components of the casing make up and running tool.

During the process of making up additional segments of casing into the casing string and lowering the casing string into the borehole, fluid must be intermittently added to the bore 32A of the casing string 32 to prevent casing damage that may result from excessive differential pressure from the annulus into the bore 32A of the casing string 32. This process, called casing fill-up, involves introducing fluid into the proximal end 46 of the casing string 32, disposing an outlet of the fluid conduit, such as a nozzle 35, within the bore 32A of the casing string 32, and by coupling the fluid conduit to a pump discharge. As new casing segments are made up into the casing string 32 and fluid within its bore 32A are introduced into the borehole, a generally offsetting volume of fluid is recovered from the annulus at the surface, conditioned to remove cuttings and debris, and reused.

A fill up and circulation assembly 29 is disposed between the launcher assembly 6 and the gripping assembly 14. The fill up and circulation assembly 29 may be used for borehole cleaning and for placing the cement slurry in the targeted interval in the annulus. This process requires pressurization of the casing string 32 by disposing a seal 30 between the proximal end 46 of the casing string 32 and the fluid conduit that supplies fluid or cement slurry to the bore 32A of the casing string 32. This enables the pump discharge to force fluid or cement slurry down the bore 32A of the casing string 32, out of the float collar (not shown) at the distal end not shown of the casing string 32) and back to the surface through the annulus. The seal 30 comprises an elastomeric circumferential packer cup seal that engages the internal wall of the casing string 32 upon sufficient insertion (as shown in FIG. 1) of the fill up and circulation assembly 29 into the proximal end 46 of the casing string 32.

In an alternate embodiment, the launcher assembly is secured above the top drive for inserting the launching members (to launch wiper plugs from a wiper plug assembly) at a position upstream of the bore of the quill 5 of the top drive 3. In the embodiment shown in FIG. 3, the launcher assembly is secured atop the top drive. The launcher assembly 6 is disposed generally above and in fluid communication with a first inlet 42 to a "Y"-tube 41. The adjacent second inlet 43 is in fluid communication with a fluid pump (not shown) for providing a source of pressurized fluid down the bore 32A of casing string 32 via the bore of the quill 5 of the top drive 3. The launcher assembly selectively releases a launching member, such as a ball or dart, into the first inlet 42 to launch a first cement wiper plug 54 from the cement wiper plug assembly 57. Upon release of the launching member into the first inlet 42 of the "Y"-tube 41, the launching member descends through the drilling fluid due to the force of gravity, and may be accelerated in its descent to the first cement wiper plug 54 by the flow of fluid from the pumps (not shown) through hose 40 and into to the second inlet 43 of the "Y"-tube 41 and downwardly through the quill 5 and the bore of the gripping assembly 14 to the bore of the cement wiper plug assembly 57 that is coupled to the gripping assembly 14.

The normal method of using the casing make-up and running tool of the present invention involves the steps of making up add-on casing segments into a casing string by gripping a casing segment with the gripping assembly 14, rotating the casing segment using the top drive 3 to threadably couple the add-on casing segment to the casing string suspended in the borehole, suspending the casing 32 from the gripping assembly 14 which is, in turn, coupled to and suspended from the top drive 3, lowering the casing string 32 into the borehole (not shown), transferring the weight of the casing string 32 to the spider (not shown) on the rig floor, using the top drive 3 and casing running tool 10 to pick up a new joint of casing, threadably connecting the new joint to the proximal end 46 of the casing string 32, filling the joint of casing with fluid, transferring the weight of the casing string 32 from the spider at the rig floor back to the top drive 3, and lowering the lengthened casing string 32 into the borehole. The process is repeated until the casing string achieves the desired length, and then a predetermined volume of cement slurry is mixed, circulated down the bore 32A of the casing string 32 and into the targeted interval of the annulus in generally the same manner used to circulate fluid. Using a check valve in the float assembly to prevent reverse flow back into the bore of casing string, the cement is held static in the targeted interval of the annulus until it sets.

Cement placement in the annulus requires cooperation of the launcher assembly 6, fill up and circulation assembly 29, the cement wiper plug assembly (see element 57 of FIGS. 1-4) and a float assembly (not shown) that is coupled to the distal end of the casing string 32 and run into the borehole at the bottom of the casing string 32. After the float assembly is run into the borehole, joints of casing are threadably made up, according to the method described above, and run into the borehole using the casing make up and running tool to create a casing string and to position the float assembly near the bottom of the targeted borehole interval. The float assembly generally comprises a biased valve that permits flow of fluid from the bore 32A of the casing string 32 into the annulus, while opposing reverse flow from the annulus into the bore 32A of the casing string 32. The float assembly also comprises a plug landing receptacle disposed in alignment with the bore 32A of the casing string 32 and positioned to receive a cement wiper plug introduced into the bore at the surface and pumped through the bore to land on the float assembly.

As shown in FIG. 2, the cement wiper plug assembly 57 is coupled to the distal end of the gripping assembly 14. The cement wiper plug assembly 57 comprises a proximal of cement wiper plug 52 and a distal cement wiper plug 54, the latter releasably secured to the former in an aligned configuration, each having an internal bore for extending the fluid conduit into the bore 32A of the casing string 32. This arrangement provides for unimpaired fluid circulation right up until the introduction of the cement slurry. The leading distal cement wiper plug 54 is launched ahead of the volume of cement slurry to prevent fouling of the cement slurry due to mixing with the fluid used to drill and circulate the borehole. A coupler 53 within the cement wiper plug assembly 57 couples to and extends the fluid conduit used to introduce fluid and cement slurry into the bore 32A of the casing string 32.

As shown in FIG. 2, the cement wiper plugs 52, 54 are adapted to circumferentially engage and slide along the internal wall within the bore 32A of the casing string 32 after being inserted. Each cement wiper plug 52, 54, and coupler 53 that releasably secures the distal cement wiper plug 54 to the proximal cement wiper plug 52, has a bore 55 that extends the fluid conduit further into the bore 32A of the casing string 32 when the cement wiper plug assembly 57 is coupled to the distal end 14B of the fill up and circulation assembly 29. The cement wiper plug assembly 57 may also couple to the distal end of the fill up and circulation assembly 29 on embodiments of the present invention having external gripping assemblies for gripping and supporting the casing string, as shown in FIG. 3.

The cement wiper plug assembly 57 is optimally secured to the casing make up and running assembly of the present invention just before picking up the last joint of casing to be made up into the casing string 32 in accordance with the method described above. This structure and method provides the significant benefit of preventing delay between borehole cleaning and the placement of cement, and results in cement liners having improved integrity. The bore 55 of the cement wiper plug assembly 57 (in FIGS. 2-4) facilitates circulation of fluid for cleaning of the annulus right up to the introduction of cement slurry into the bore 32A of the casing string 32 for placement of cement slurry in the targeted interval.

Figure 3:
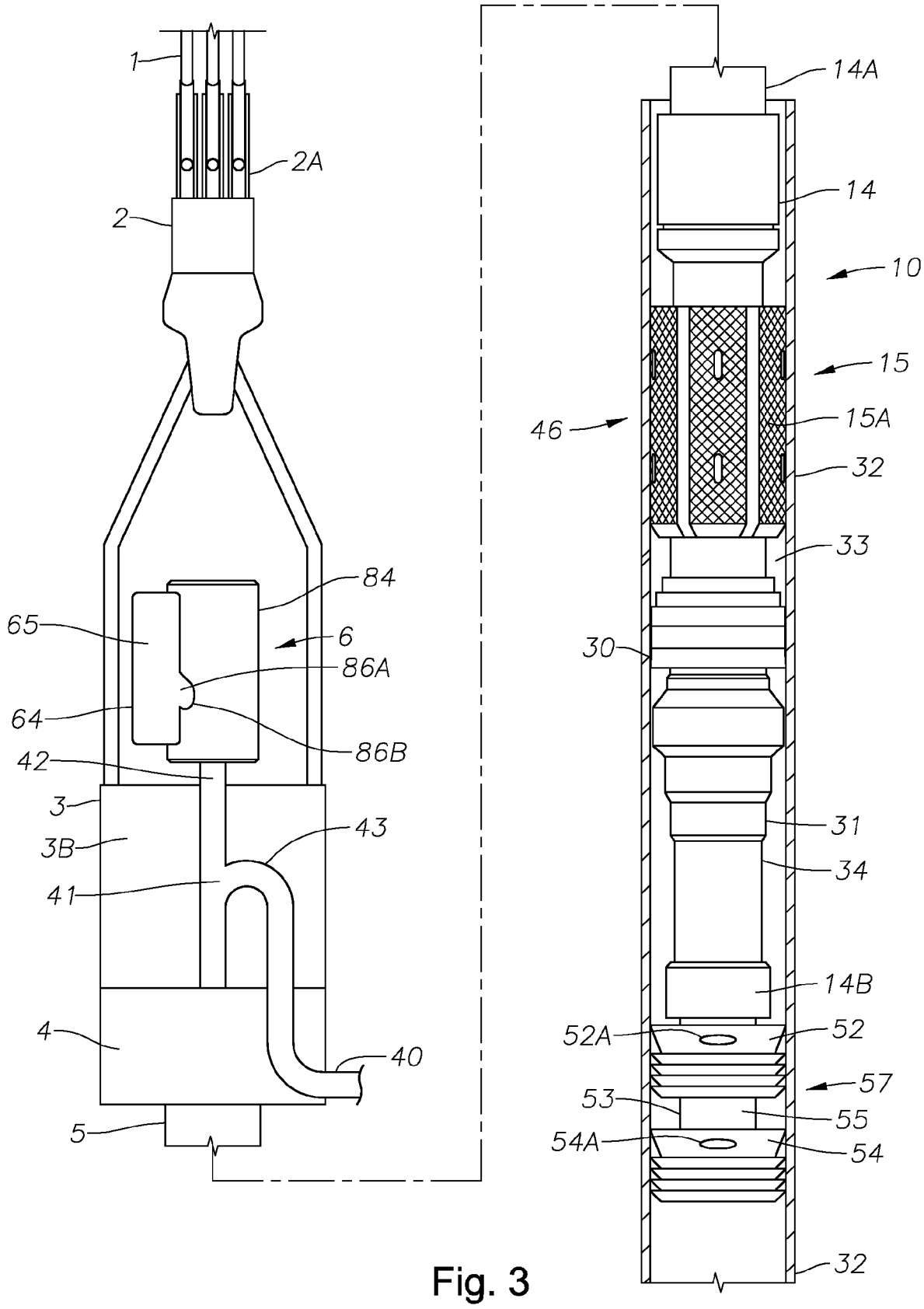
FIG. 3 is an elevation view, with the casing pipe shown in cross-section, of one embodiment of the casing make-up and running tool of the present invention having a top drive supporting a launcher assembly atop the top drive and a fill up and circulation assembly from underneath. The casing make-up and running tool also supports a rotatable external gripping assembly for gripping and supporting the casing string.
Figure 4:
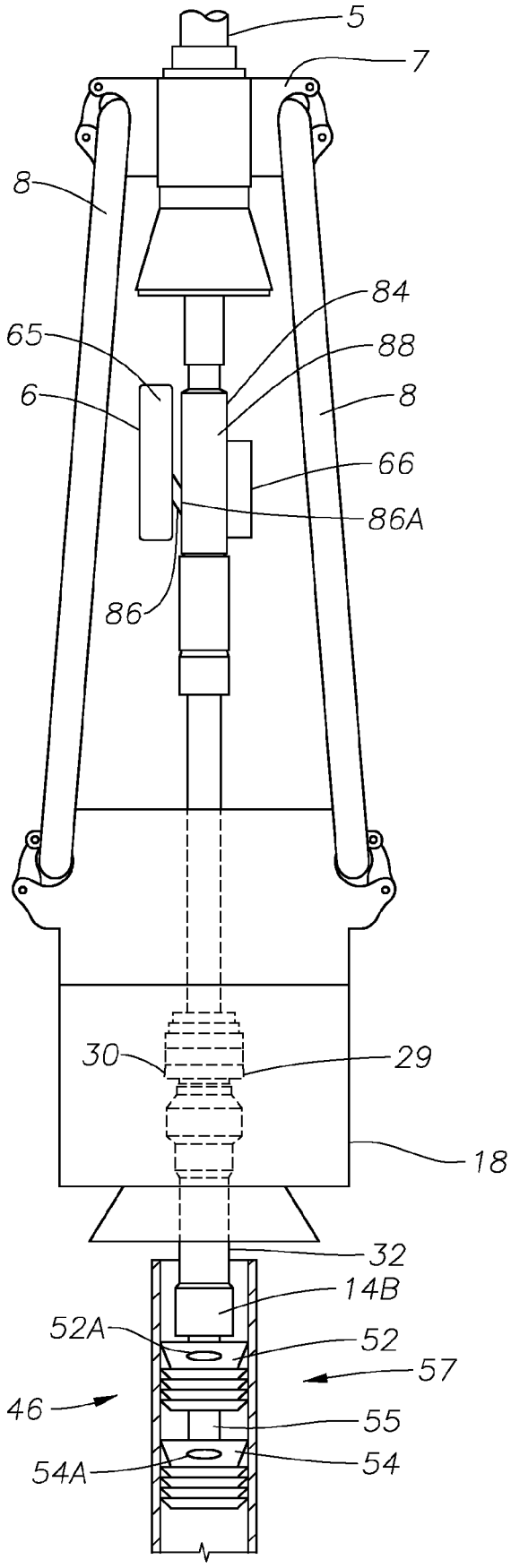
FIG. 4 is an elevation view, with casing pipe shown in cross-section, of one embodiment of the launcher assembly of the present invention having a launcher assembly supporting a fill up and circulation tool and an externally gripping elevator suspended by a pair of bails from a top drive.

The launcher assembly 6 in FIGS. 2-4 is used to control the deployment of the cement wiper plugs into the bore 32A of the casing string 32. For purpose of illustration, and not by way of limitation, the launched device may be a ball, but it should be clear that darts or other launching members may be substituted for balls without loss of function. As shown in FIG. 4, two balls 42, 44 of different diameters are stored in the chamber 65 for being selectively launched into the bore 88 of the launcher sub 84. The seat 52A of the proximal (upper) cement wiper plug 52 (see FIG. 2) has a slightly larger bore than the seat 54A of the distal (lower) cement wiper plug 54 (see FIGS. 2-4). The seat of each of the plugs is adapted for receiving and capturing its mating launching member to substantially seal the bore in that plug and to isolate the lower portion of the bore 32A of the casing string 32 from the pump discharge to pressurize the fluid conduit. The smaller launching member 44 is first captured in the seat 54A of the distal cement wiper plug 54 (see FIGS. 2-4), and the larger launching member 42 is later captured in the seat 52A of the proximal cement wiper plug 52 (see FIGS. 2-4).

Pressurization of the fluid conduit between a wiper plug having a seated launching member and the pump discharge launches the selected cement wiper plug into the bore 32A of the casing string 32 by sacrificial failure of one or more set screws (not shown) adapted for shearing failure at a threshold force to separate the selected cement wiper plug from the coupler 53.

The distal cement wiper plug 54 is first deployed by release from the storage chamber 65 of the smaller launching member, in this case a ball 44, (see FIG. 5) into the passageway 86. The launched distal cement wiper plug 54 is followed into the bore 32A of the casing string 32 by the volume of cement slurry introduced through the cement adapter 66. After the predetermined volume of cement is pumped into the fluid conduit, the larger launching member, shown as a larger ball 42, is launched from the storage chamber 65 into the passageway 86 and into the fluid conduit, and received in the seat 52A of the proximal cement wiper plug 52 to substantially close the bore. Pressurization of the fluid conduit between the pump discharge and the seated launching member deploys the proximal cement wiper plug 52 into the bore 32A of the casing string 32 releasing the cement wiper plug at a predetermined force to separate the proximal cement wiper plug from the coupler 53. Each deployed cement wiper plug provides a moving barrier separating, for the distal cement wiper plug 54, the cement slurry behind the plug from the fluid ahead of the plug, and for the proximal cement wiper plug 52, the cement slurry ahead of the plug from the fluid behind the plug.

After the distal plug 54 is deployed into the bore 32A of the casing string 32, the plug descends to land on the float collar (not shown). The distal cement wiper plug 54 lands on the float collar at the distal end of the casing string 32, and the pump discharge pressure temporarily increases to open up the through bore in the distal cement wiper plug 54. Opening a through bore allows the cement slurry behind the distal cement wiper plug 54 to flow from the inside bore 32A of the casing string 32 into the annulus, and to be displaced by continued pumping back toward the surface to a predetermined level within the annulus.

After the specific volume of cement slurry is displaced into the annulus, the proximal cement wiper plug 52 lands on the distal cement wiper plug 54 at the float collar at the distal end of the casing string to again temporarily isolate the bore 32A of the casing string 32 from the annulus. Pressurization of the fluid conduit against the proximal cement wiper plug 52 indicates that the plugs have "bumped."

Figure 5:
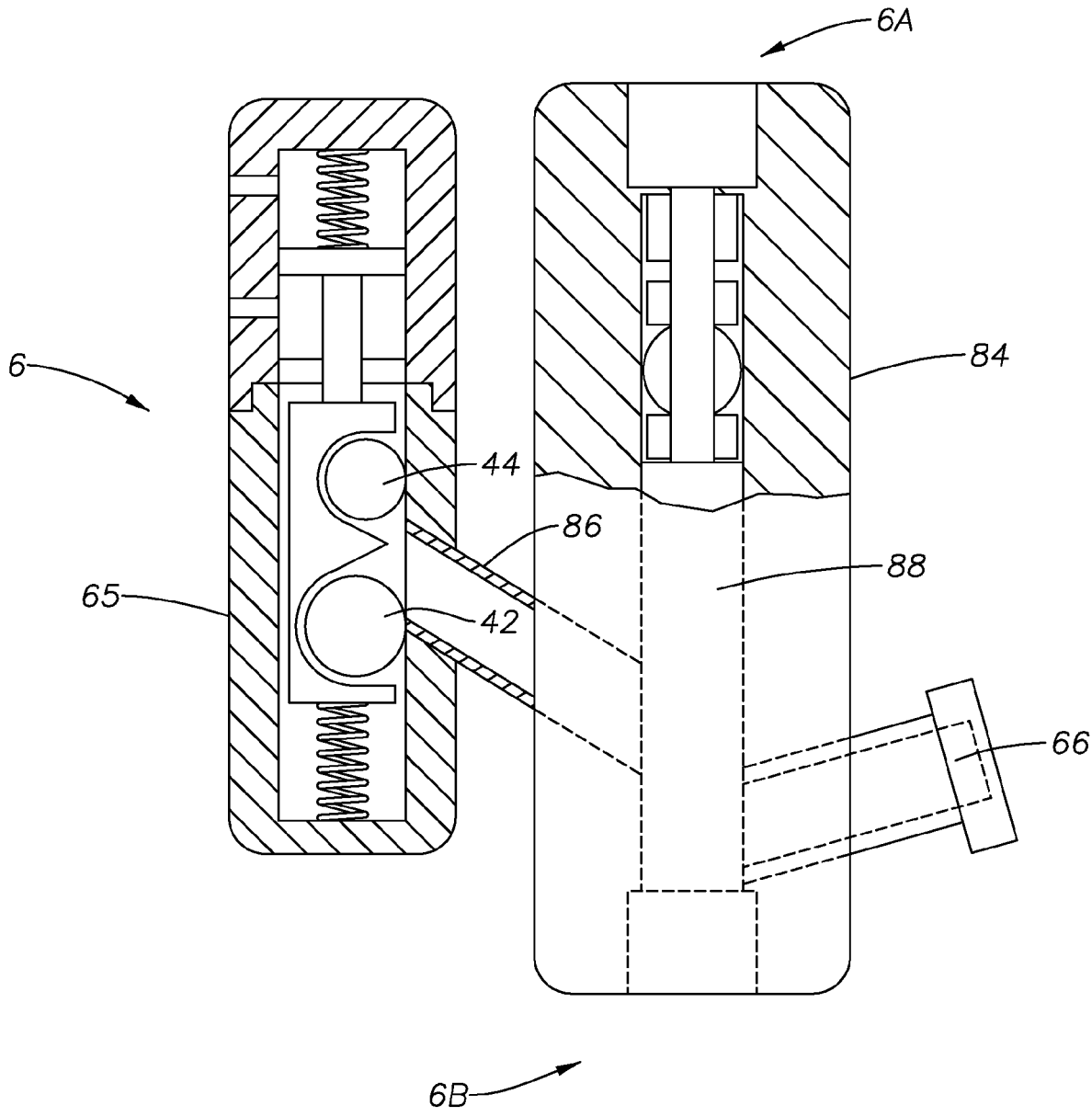
FIG. 5 is a cross-sectional elevation view of a launcher assembly of a type compatible for use with the present invention.

The launcher assembly 6 shown in FIG. 5 may comprise one or more safety features to prevent inadvertent launching of the larger launching member 42 before the smaller launching member 52. The launcher assembly 6 facilitates the introduction of the selected launching member into the fluid conduit and to the seat in the bore of the targeted cement wiper plug.

Cement slurry may be introduced into the bore 32A of the casing string 32 in the same manner as the fluid, i.e. through the fluid hose 40, and the bore 5A of the quill 5 of the top drive. Preferably, cement slurry is introduced directly into the bore 88 of the launcher sub 84 through the cement adapter 66 shown in FIGS. 1, 2 and 4. The cement adapter 66 provides an alternate point of entry for cement slurry to prevent erosion damage to seals and other components exposed to the fluid conduit in the top drive 3. The cement adapter 66 may be disposed within or near the launcher assembly 6, as shown in FIGS. 1, 2, and 4, and is adapted for coupling to the discharge of a cement supply hose (not shown) that is coupled at its inlet to the discharge of a cement pump (not shown). A valve (not shown) may be disposed within the fluid conduit formed by the bores of the quill 5 and the launcher sub 84 to prevent unwanted flow of pressurized cement slurry introduced into the cement adapter 66 from entering the top drive.

FIG. 4 is an elevation view of an alternate embodiment of the casing make up and running tool of the present invention having an external gripping assembly 18. The quill 5 of the top drive (not shown) rotatably supports a lift collar 7 that, in turn, supports the external gripping assembly 18 through a pair of bails 8, and the top drive fluid conduit extends downwardly through the aligned bores of the quill 5, the launcher sub 84 and the fill up and circulation assembly 29. The fill up and circulation assembly 29 is adapted for receiving and supporting a cement wiper plug assembly 57 at its distal end in the same manner as described above in relation to FIG. 2. The bore 88 of the launcher sub 84 and the bore of the fill up and circulation assembly 29 are aligned with the bore 5A of the quill 5 to extend the fluid conduit from of the top drive 3 down into the bore 32A of the casing string 32.

The fill up and circulation assembly 29 comprises a packer cup 30 that extends radially outwardly from the outside circumference of the fill up and circulation assembly 29 to engage and seal against the inside wall of the casing string 32 when the packer cup is inserted into the proximal end 46 of the casing string 32. The fluid pumps may then be activated to pressurize the bore of the fill up and circulation tool.

Additional assemblies and devices may be coupled into the casing make up and running tool to extend the fluid conduit or to manage and conserve fluid. The mud saver valve 31 generally comprises a valve that is biased closed and can be opened by pressure to permit flow from the bore of the fill up and circulation assembly 29 to the bore of the casing string at a predetermined differential pressure. The mud saver valve 31 prevents unwanted loss of fluid from the fluid conduit when the pump is inactive and the tool is pulled out of the proximal end of the casing.

The foregoing, as well as other, objects, features, and advantages of the present invention will be more fully appreciated and understood by reference to the following drawings, specification and claims.

Those who are skilled in the art will readily perceive how to modify the present invention still further. For example, many connections illustrated have been shown as threaded, however, it should be understood that any coupling means (threads, welding, O-ring, quick disconnect, etc.) which provides a leak tight connection may be used without varying from the subject matter of the invention disclosed herein. In addition, the subject matter of the present invention would not be considered limited to a particular material of construction. Therefore, many materials of construction are contemplated by the present invention. Many possible embodiments may be made of the present invention without departing from the scope thereof, and it is to be understood that all matter herein set forth or shown in the accompanying drawings is to be interpreted as illustrative and not in a limiting sense. Accordingly, the foregoing description should also be regarded as only illustrative of the invention, whose full scope is measured by the following claims.

"Gripping assembly," as that term is used herein, includes, but is not limited to, an internal cage grip tool, an internal wedge grip tool, an external elevator having a generally circumferential internal shoulder for abutting and supporting an internally threaded sleeve received on a pipe, and an elevator having an arrangement of slips for engaging the outside surface of the casing, a side door elevator, an elevator comprising internal or external slips, and all other devices used for gripping and supporting a pipe string from above the spider that may be supported by a top drive or draw works.

The terms "comprising," "including," and "having," as used in the claims and specification herein, shall indicate an open group that may include other elements not specified. The terms "a," "an," and the singular forms of words shall be taken to include the plural form of the same words, such that the terms mean that one or more of something is provided. For example, the phrase "an apparatus having a drive motor" should be read to describe an apparatus having one or more drive motors. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used in the specification to indicate that an item, condition or step being referred to is an optional (not required) feature of the invention.

While a preferred form of the present invention has been described herein, various modifications of the apparatus and method of the invention may be made without departing from the spirit and scope of the invention, which is more fully defined in the following claims. The foregoing, as well as other, objects, features, and advantages of the present invention will be more fully appreciated and understood by reference to the following claims.

We claim:

1. A system to cement a casing string in an earthen borehole, comprising:

a gripping assembly having a proximal end and a distal end, and a flow bore there between, and supported above a rig floor in an aligned position over the earthen borehole by a quill of a top drive assembly, the flow bore of the gripping assembly sealably engaging a bore of a launching assembly, the distal end of the gripping assembly being receivable within a proximal end of the casing string, and the gripping assembly being deployable to grip the casing string; and at least one cement wiper plug releasably coupled to the gripping assembly, the at least one cement wiper plug having a seat to receive a launching member.

2. The system of claim 1 wherein the at least one cement wiper plug comprises a first and a second cement wiper plug.

3. The system of claim 1 wherein the at least one cement wiper plug is launchable by introduction into the bore of the launching assembly of a first launching member sized to be received into the seat in the at least one cement wiper plug.

4. The system of claim 3 wherein the first launching member is a dart or a ball.

5. The system of claim 3 further comprising a second cement wiper plug.

6. The system of claim 1 further comprising a seal to engage a wall of the casing string, a mandrel with a bore in fluid communication with the bores of the launching assembly and the gripping assembly, and a valve in communication with the bore of the mandrel.

7. A system to deliver at least one launching member to a first launchable cement wiper plug, comprising:

a top drive assembly having a rotatable quill with a bore there through;

a gripping assembly supported above a rig floor to releasably grip and support a proximal end of a casing string within an earthen borehole, the gripping assembly having a proximal end and a distal end and a bore there between in fluid communication with the bore of the quill of the top drive assembly;

a launching assembly having a first bore in fluid communication with the bore of the quill of the top drive assembly, and a chamber to releasably store at least one launching member; and a coupling connected to the gripping assembly to support a cement wiper plug assembly comprising the first launchable cement wiper plug;

wherein the first launchable cement wiper plug comprises a seat to receive the first launching member.

8. The system of claim 7 wherein the cement wiper plug assembly further comprises a second launchable cement wiper plug.

9. A system to cement a casing string in an earthen borehole, comprising:

a top drive assembly having a rotatable quill with a fluid bore connectable to a source of a pressurized fluid to deliver the pressurized fluid to a bore of the casing string; and a gripping assembly supported above a rig floor and comprising a bore there through, a first coupling at a proximal end of the gripping assembly releasably coupling the gripping assembly to the quill, and a second coupling releasably coupling the gripping assembly to at least one launchable cement wiper, and a bore there between in fluid communication with the bore of the quill;

a ball launching assembly comprising a chamber to releasably store one or more launching members and a launching bore in fluid communication with the bore of the gripping assembly;

wherein at least one cement wiper plug is releasably coupled to the gripping assembly and has a seat sized to receive a mating launching member released from the ball launcher assembly to substantially restrict the bore of the cement wiper plug.

10. A system to make-up and/or run a casing string into a borehole, comprising:

a launching assembly to provide a launching member to a launching bore in fluid communication with the bore of a quill of a top drive assembly;

a fill up and circulation assembly comprising:

a proximal end supportable by the launching assembly and a bore between the proximal end and a distal end, the bore alignable with the bore of the launching bore, an external circumferential seal sized to sealably engage an internal wall of the casing string;

a coupling to receive and support a cement wiper plug assembly within the casing string; and a gripping assembly to releasably engage the casing string above a rig floor;

wherein the at least one cement wiper plug of the cement wiper plug assembly is deployable into the bore of the casing string by release of a launching member from the launching assembly and into the bore of the fill up and circulation assembly.

11. The system of claim 10 wherein the proximal end of the fill up and circulation assembly is supported by a distal end of the launcher assembly.

12. The system of claim 11 wherein the external circumferential seal is positioned below the gripping assembly.

13. The system of claim 10 wherein the launcher assembly is positioned on the top drive assembly.

14. The system of claim 10 wherein the storage chamber of the launching assembly can releasably store a first launching member and then a second launching member to launch a first cement wiper plug and a second cement wiper plug respectively.

15. The system of claim 10 further comprising a cement sub comprising a bore in fluid communication with the bore of the fill up and circulation assembly, and an inlet in fluid communication with the bore of the cement sub and a source of pressurized cement slurry.

16. A system to facilitate the control of fluid flow or cement slurry placement in a cased borehole, comprising:

a top drive assembly having a rotatable quill with a bore in fluid communication with a bore of a casing string;

a launching assembly having a launching member storage chamber in fluid communication with the bore of the quill;

a fill up and circulation assembly having a bore aligned with and in fluid communication with the bore of the quill and an external circumferential seal sized to engage the bore of the casing string; and a gripping assembly having a bore, a pair of ears and slips for gripping the casing string;

wherein the gripping assembly is supportable by bails, each having a first end and a second end, the first end coupled to and supported by the top drive assembly, and the second end coupled to and supporting the gripping assembly at the pair of ears.

17. The system of claim 16 wherein the launching member storage chamber stores and releases one or more launching members into the first bore of the launcher assembly.

18. The system of claim 17 wherein the gripping assembly comprises a first end and a second end supporting at least one detachable cement wiper plug.

19. The system of claim 18 wherein the cement wiper plug assembly comprises a plurality of detachable cement wiper plugs.

20. The system of claim 16 further comprising a cement sub comprising a bore in fluid communication with the bore of the fill up and circulation assembly, and an inlet in fluid communication with the bore of the cement sub, the inlet adapted to sealably couple to a cement conduit.

21. A system to cement a casing string in an earthen borehole, comprising:

a gripping assembly having a proximal end and a distal end, and a flow bore there between, and supported above a rig floor in an aligned position over the earthen borehole by a quill of a top drive assembly, the flow bore of the gripping assembly sealably engaging a launching bore to receive a launching member, the distal end of the gripping assembly being at least one of receivable within and receivable about, a proximal end of the casing string, and the gripping assembly deployable to grip the casing string; and at least one cement wiper plug releasably supported from the gripping assembly, the at least one cement wiper plug having a seat to receive the launching member.

22. The system of claim 21 further comprising a second cement wiper plug.

23. The system of claim 21 wherein the launching bore is proximate the top drive quill.

24. The system of claim 21 wherein the launcher assembly is detached from both the top drive assembly and from the gripping assembly.

25. The system of claim 21 further comprising:

a source of cement slurry fluidically coupled to the bore of the gripping assembly.

26. A system to cement a casing string in an earthen borehole, comprising:

a launching member releasable to a launching bore in fluid communication with the bore of a quill of a top drive assembly;

a mandrel having a distal end receivable within the bore of the casing string, a proximal end supported from the quill, and a bore there between in fluid communication with the bore of the quill;

a seal to engage a wall of the casing string;

a gripping assembly having a proximal end and a distal end that is at least one of receivable within the bore of, or receivable about the proximal end of, the casing string; the casing string extending above a rig floor; and at least one cement wiper plug;

wherein the at least one cement wiper plug is deployable into the bore of the casing string by release of the launching member into the launching bore.

27. A method to cement a casing string into a borehole, comprising:

supporting a mandrel from the quill of a top drive with a bore through the mandrel in fluid communication with the bore of the quill;

receiving a distal end of the mandrel into a bore of the casing string extending from above a rig floor into the borehole;

engaging a wall of the casing string with a seal coupled to the mandrel;

gripping the casing string above the rig floor with a gripping assembly supported by the top drive;

releasably coupling to the mandrel at least one cement wiper plug above the rig floor and in the bore of the casing string; and pumping a cement slurry to the bore of the mandrel.

28. The method of claim 27 further comprising releasing from above the rig floor the at least one cement wiper plug into the bore of the casing string.

29. The method of claim 28 wherein the step of releasing the at least one cement wiper plug comprises launching a launching member into the bore of the mandrel to deploy the at least one cement wiper plug.

30. The method of claim 29 further comprising the step of:

launching a second launching member into the bore of the mandrel to deploy a second cement wiper plug releasably coupled to the mandrel into the bore of the casing string.

31. The method of claim 29 further comprising the step of:

displacing the at least one cement wiper plug into the bore of the casing string below the rig floor by introducing a fluid into the bore of the mandrel.

32. The method of claim 31 wherein the fluid is the cement slurry.

* * * * *